United States Patent [19]

Oakes

[11] 3,993,230

[45] Nov. 23, 1976

[54] ADHESIVE TAPE DISPENSER

[76] Inventor: Thomas B. Oakes, Falls Road, Shelburne, Vt. 05482

[22] Filed: Nov. 19, 1975

[21] Appl. No.: 633,429

Related U.S. Application Data

[63] Continuation-in-part of Ser. No. 487,123, July 10, 1974, abandoned.

[52] U.S. Cl. ..... 225/47; 206/815; 224/28 F; 225/53; 225/56; 225/77; 225/90; D19/69

[51] Int. Cl.[2] ..... B26F 3/02

[58] Field of Search ..... 225/46, 47, 53, 56, 225/77, 79, 80, 90, 91; 83/649; 224/28 R, 28 B, 28 D, 28 F, 28 H; 242/55.2, 55.53, 84.2 J, 85.1, 96; 206/815; D19/67, 68, 69

[56] References Cited

UNITED STATES PATENTS

| | | | |
|---|---|---|---|
| 1,286,610 | 12/1918 | Harriman | 224/28 F |
| 2,084,343 | 6/1937 | Jefferis | 224/28 F |
| 2,109,609 | 3/1938 | Aull | 224/28 F |
| 2,140,231 | 12/1938 | Jefferis | 224/28 F |
| 2,697,564 | 12/1954 | Haney et al. | 242/84.2 J X |
| 2,929,540 | 3/1960 | Carey | 225/47 |
| 2,961,184 | 11/1960 | Alford | 242/96 |
| 3,762,261 | 10/1973 | Ekenberg | 225/56 X |
| 3,799,417 | 3/1974 | Williams | 83/649 X |
| D225,577 | 12/1972 | Boyce | D19/69 |

*Primary Examiner*—Othell M. Simpson
*Assistant Examiner*—Fred A. Silverberg
*Attorney, Agent, or Firm*—Robert T. Gammons

[57] ABSTRACT

An adhesive tape dispenser provided with finger gripping openings for mounting the dispenser on the back of the hand so as to enable holding the dispenser on one hand while pulling the tape from the dispenser with the other hand and severing it so that the fingers of both hands can be employed to apply the severed tape.

5 Claims, 13 Drawing Figures

ADHESIVE TAPE DISPENSER

This is a continuation-in-part of the now abandoned application Ser. No. 487,123, filed July 10, 1974.

BACKGROUND OF INVENTION

There are a variety of tape dispensing devices available designed to facilitate withdrawing the tape and severing it and some of these are provided with finger rcesses or the like to enable grasping the holder as the tape is withdrawn such as shown in U.S. Pat. Nos. 3,762,261; 2,309,396; 3,494,020; 3,134,526; 2,572,245 and 3,186,892. In all of these prior devices there are at most fingertip receiving recesses or openings and these are located in such positions that the tape dispenser cannot be held on the back of the hand in an out of the way position so as to free the hands for manipulating the severed tape and/or holding the work to which it is to be applied, nor are these recesses or openings so located as to enable obtaining a firm and rigid grip on the dispenser to facilitate tearing off the tape. The purpose of this invention is to provide a dispenser which can be firmly held without interfering with complete freedom of the hand on which the dispenser is supported for use in holding and applying the tape.

SUMMARY OF INVENTION

As herein illustrated the dispenser comprises a support, means on the support for rotatably receiving a roll of tape for rotation about a predetermined axis, a cutter on the support having a cutting edge spaced from and parallel to the axis of the roll of tape over which the tape is adapted to be withdrawn in a direction at right angles to the axis of the roll of tape for severance and means for mounting the dispenser on the back of the hand such that the direction of draw-off is transverse to the hand, comprising a finger grip on the support disposed at right angles to the axis of the roll of tape about which the fingers are adapted to be closed. As herein illustrated, the finger grip is constituted in one form by an opening through the support spaced from and parallel to the axis of rotation of the roll of tape and a bearing element situated laterally thereof which also has a surface spaced from and parallel to the axis of rotation of the roll of tape situated at a distance from the finger gripping opening so as to have engagement with the adjacent finger in normal position of adjacency, said finger opening and surface collectively providing support for supporting the device at the back side of the fingers substantially perpendicular to and transversely of the back of the hand, so that rotation of the device about the axis of the finger gripping opening is prevented by engagement of said surface with the adjacent finger. The surface of the bearing element may be constituted by an adjacent portion of the support or a second opening through the support adjacent to, spaced from and parallel to the finger gripping opening or in communication with the finger gripping opening. Optionally, the second opening may have an open side to permit disengagement of the finger laterally from the second opening.

The invention will now be described in greater detail with reference to the drawings, wherein.

Figure 4:
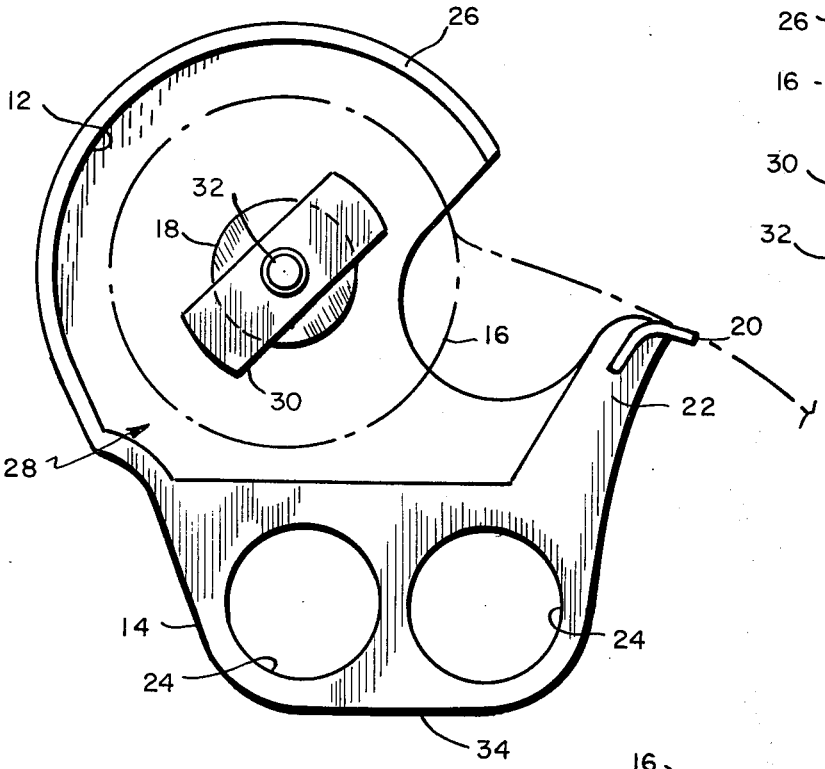
FIG. 4 is an elevation of a modified form of the invention showing two finger openings for mounting it on the hand.

Referring to the drawings, the dispenser in its simplest form comprises a support 10 having upper and lower parts 12 and 14, the upper part 12 being designed to rotatably support a roll of tape 16 and the lower part 14 being designed to enable mounting the dispenser on the back of the hand.

For mounting the roll of tape on the upper part there is provided a spool or spindle 18 which is fastened at one end to the upper part so as to extend perpendicularly therefrom.

The tape is drawn off the roll of tape in a direction at right angles to the axis of the spool across a cutter 20 in the form of a flat serrated edge blade fastened to a bill 22 extending upwardly from the bottom part.

Figure 2:
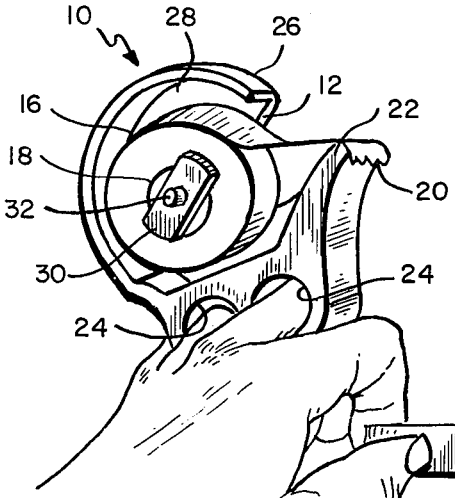
FIG. 2 is an elevation of FIG.1 as seen from the right side thereof.
Figure 2:
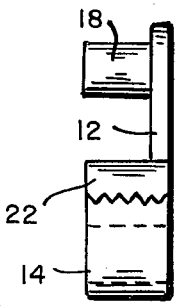

As can be seen from FIG. 2 the upper part is a relatively thin plate and the lower part is a block the thickness of which corresponds substantially to the thickness of the plate plus the axial length of the spool or spindle 18. The bill 22 which extends upwardly from the base is of corresponding width.

Figure 6:
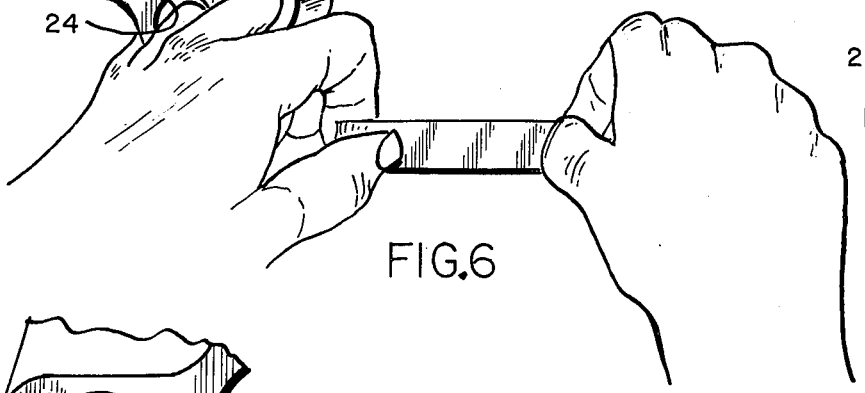
FIG. 6 is a perspective showing the position of the dispenser illustrated in FIGS. 1 and 2 mounted on the back of one hand of the person using the dispenser.

The means for supporting the dispenser on the hand comprise, in one form, spaced finger holes or openings 24—24 extending through the lower part 14 parallel to the axis of the spool or spindle for receiving the fingers of the hand as shownn in FIG. 6 so as to support the dispenser transversely of the hand with the direction of pull-off transverse to the hand. The holes 24—24 are made of a size to receive the upper joints of the fingers as illustrated in FIG. 6.

Figure 3:
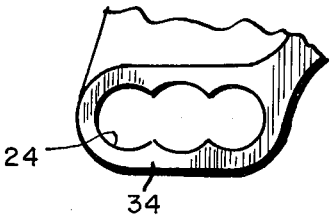
FIG. 3 is a fragmentary view of the lower part of the dispenser provided with inter-connected openings for receiving the fingers.

Instead of using spaced apart finger holes 24—24 the finger holes 24 may be interconnected as shown in FIG. 3.

Figure 5:
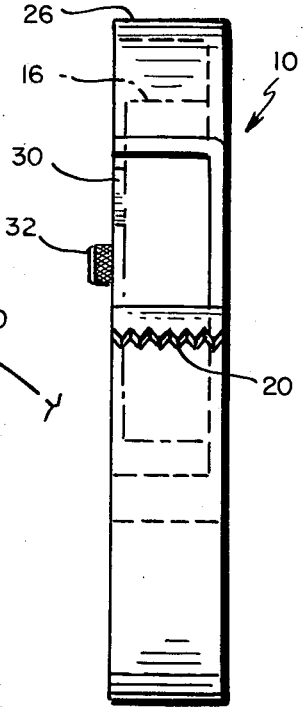
FIG. 5 is an elevation as seen from the right hand side of FIG. 4.
Figure 1:
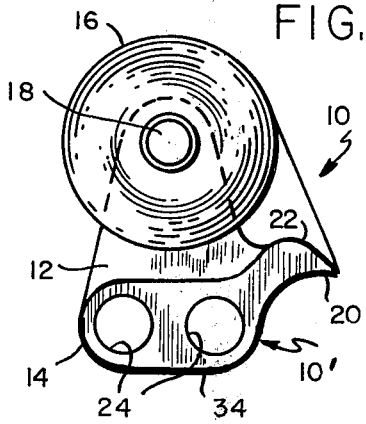
FIG. 1 is an elevation of the invention in its simplest form and wherein there are two finger openings for mounting it on the back of the hand.

A modification of the dispenser is shown in FIGS. 4, 5 and 6 wherein the upper part 12 of the support is enlarged to extend beyond the periphery of the roll of tape and is provided along its outer edge with a circumferential flange 26 which provides, in conjunction therewith , an open sided chamber 28 which partially confines the roll of tape.

In either form of the dispenser the roll of tape 16 is retained on the spool by suitable means, one such means shown in FIG. 4 comprising a flat bar 30 detachably mounted at the outer end of the spool or spindle by means of a thumb screw 32.

The bottom part 14 of the dispenser is preferably provided with a flat surface 34 by means of which the dispenser may be set upright on a flat supporting surface.

Alternative forms of the dispenser are shown in FIGS. 7 to 13 inclusive wherein the mounting for the roll of tape and the cutter are the same, the differences residing in the arrangement and disposition of the finger openings by means of which the device is supported on the back of the hand to make it easier to disengage one of the fingers for applying the detached piece of tape.

Figure 7:
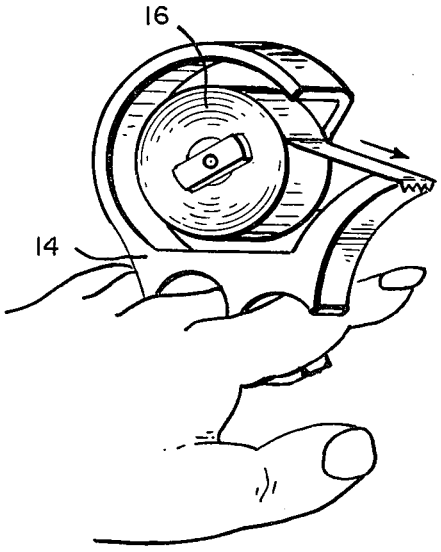
FIG. 7 is a perspective view of a modification of FIG. 4 wherein one of the finger openings has an open side showing the fingers engaged with the openings.
Figure 8:
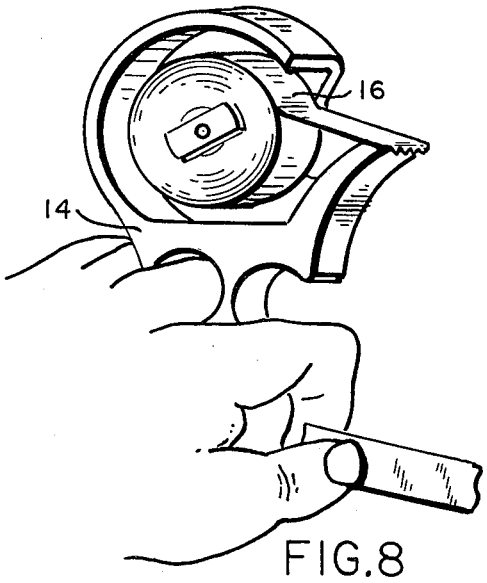
FIG. 8 is a view corresponding to FIG. 7 showing the forefinger disengaged from the open side opening for applying a piece of tape.
Figure 10:
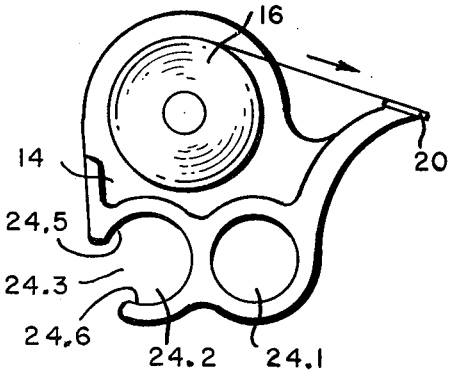
FIG. 10 is an elevation partly in section with the finger opening open side reversed.

Referring specifically to FIGS. 7 and 8, the lower part 14 of the dispenser is provided with openings 24.1 and 24.2, the latter having a side opening side 24.3 so that as shown both fingers may be engaged with the device while drawing off the tape and after the tape has been severed the index finger may be easily disengaged from the opening 24.2 through the side opening 24.3 to assist in manipulating the tape. The open side opening 24.3 makes it much easier to disengage the index finger when the middle and index fingers are used for supporting the device. FIG. 10 shows the openings reversed, that is, with the openings 24.1 on the same side as the cutter and the opening 24.2 on the opposite side.

Figure 9:
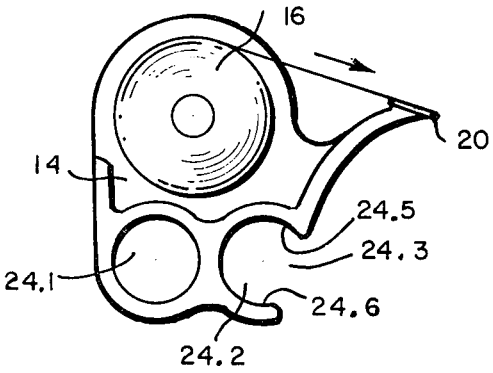
FIG. 9 is an elevation partly in section corresponding to FIGS. 7 and 8.
Figure 11:
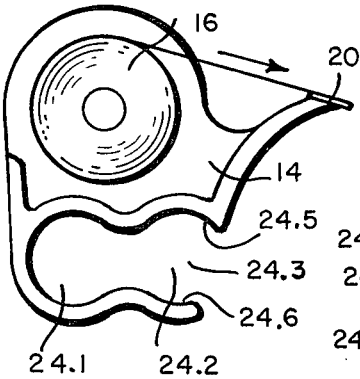
FIG. 11 is an elevation partly in section with the finger openings interconnected.
Figure 12:
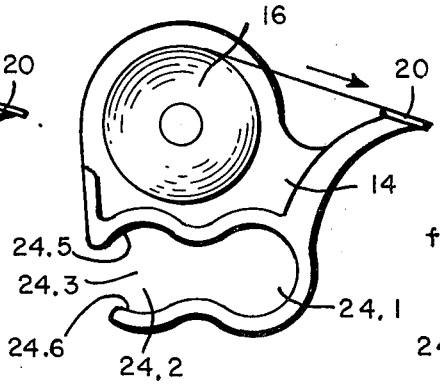
FIG. 12 is an elevation partly in section with the finger openings reversed.

FIGS. 11 and 12 are similar to FIGS. 9 and 10 with the exception that the openings 24.1 and 24.2 are interconnected.

Figure 13:
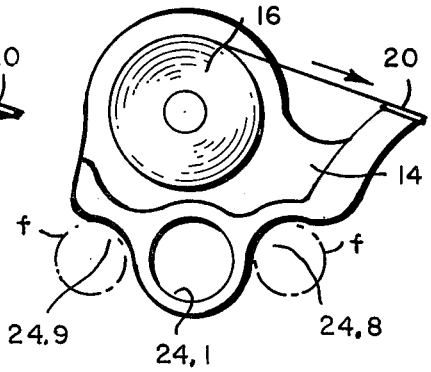
FIG. 13 is an elevation partly in section with a single finger opening and a bearing surface for engagement with an adjacent finger.

FIG. 13 shows the base 14 provided with a single opening 24,1,

All of the devices shown in FIGS. 7 through 13 inclusive have in common a finger gripping opening for receiving one of the fingers of the hand by means of which the device may be gripped and a surface adjacent thereto which may be a part of an opening as shown in FIGS. 9, 10, 11 and 12 or on an adjacent surface of the part which, by engagement with an adjacent finger, operates to prevent rotation of the device about the axis of the finger engaged within the finger gripping opening. Referring to FIG. 9, the concave surface 24.5 by engagement with the top or back of the index finger prevents rotation of the device clockwise about the axis of the finger engaged with the opening 24.1 when a pull is exerted on the tape in the direction of the arrow. Convex surface 24.6 by engagement with the bottom or inner side of the index finger opposes rotation of the device in a counterclockwise direction, for example, after the tape has been torn off, prevents the device from tilting over backward.

In FIG. 10 the concave surface 24.6 opposes the pull on the tape and the concave surface 24.5 and opposes tipping over backward. In each of the devices shown in these two figures the open side 24.3 permits the fingers to be readily introduced and removed from engagement with the bearing surfaces 24.5 and 24.6.

In FIGS. 11 and 12 the concave surfaces 24.5 and 24.6 operate in the same way.

FIG. 13 shows a form in which a single finger gripping opening 24.1 is employed, however, the surface 24.8 at the one side is designed to have engagement with the adjacent finger at that side indicated by the dotted line *f* to prevent overturn of the device about the axis of the finger engaged with the opening 24.1. Backward rotation in the opposite direction is prevented by the surface 24.9. This latter form is not as efficient as that of the form shown in the previous figures since the bearing surfaces are closer to the axis of the finger gripping opening and so do not provide as much resistance to overturn.

It is clear by reference to FIG. 6 that with the dispenser mounted on the back of the hand by engagement of two fingers with the finger opening, it is possible to strip the tape from the roll of tape and sever it, leaving both hands free to manipulate the severed tape for application.

The dispenser may be comprised of any suitable inexpensive material, for example, sheet metal or plastic, formed or molded to the desired shape. If desired the blade at the end of the bill may be omitted and the end of the bill may be made sharp enough to affect cutting of the tape. Also, a plastic or metal spool which is deformable at its distal end to retain the roll of tape may be employed.

It should be understood that the present disclosure is for the purpose of illustration only and includes all modifications or improvements which fall within the scope of the appended claims.

I claim:

1. A dispenser of the kind comprising a support for rotatably receiving a roll of tape for rotation about a predetermined axis for withdrawal from said roll over a cutting edge parallel to the axis of the roll a length of tape; characterized in that the support embodies means for mounting and retaining the dispenser transversely on the back of the fingers of the hand with the axis of the roll of tape substantially parallel to the fingers so that the direction of the tape as drawn off is transverse to the hand, comprising an elongated finger gripping opening in the support spaced from and parallel to the axis of the roll of tape, said finger gripping opening being of a size to receive the proximal phalanx of a finger so that the medial and distal phalanxes extend beyond the support to assist in holding and manipulating a part to which the tape is to be applied and a bearing element situated laterally of the finger gripping opening having a concave surface, having a radius of curvature which corresponds substantially to the finger opening, said concave surface being spaced from and parallel to the axis of the roll of tape and at a lateral distance from the finger gripping opening such as to have engagement with the adjacent finger in its normal position of adjacency, said finger gripping opening and concave bearing surface collectively provide transversely spaced supports by means of which the device is supported at the back side of the fingers substantially perpendicular to and transversely of the back of the hand and said concave bearing surfaces by engagement with the adjacent finger preventing rotation of the device about the finger engaged with the finger gripping opening.

2. A device according to claim 1, wherein said concave bearing surface is a portion of an opening spaced from and parallel to the finger gripping opening.

3. A device according to claim 1, wherein said concave bearing surface is a portion of an opening spaced from and parallel to the finger gripping opening and has an open side.

4. A device according to claim 1, wherein said concave bearing surface is a portion of an opening from and parallel to the finger gripping opening which is in communication with the finger gripping opening.

5. A device according to claim 1, wherein said concave bearing surface is a portion of an opening spaced from and parallel to the finger gripping opening which is in communication with the finger gripping opening and which contains an open side.

* * * * *